United States Patent [19]

Wong

[11] Patent Number: 4,989,821

[45] Date of Patent: Feb. 5, 1991

[54] SUPPORT DEVICES FOR PRODUCING VARIABLE HEIGHT BARRIERS

[76] Inventor: William P. W. Wong, 3030 Montrose Ave., La Crescenta, Calif. 91214

[21] Appl. No.: 361,510

[22] Filed: Jun. 5, 1989

[51] Int. Cl.[5] ..... F16M 13/00

[52] U.S. Cl. ..... 248/529; 119/29; 248/157; 248/228; 248/911

[58] Field of Search ..... 119/29; 256/DIG. 2; 248/157, 250, 912, 218.4, 219.4, 911, 558, 228, 182, 529

[56] References Cited

U.S. PATENT DOCUMENTS

| | | | |
|---|---|---|---|
| 982,866 | 1/1911 | Poppendieck | 248/529 X |
| 2,616,650 | 11/1952 | Thompson | 248/529 X |
| 3,386,590 | 6/1968 | Gretz | 211/182 X |
| 3,749,344 | 7/1973 | Racina | 248/218.4 |
| 4,026,508 | 5/1977 | Ziegler | 248/912 X |
| 4,065,089 | 12/1977 | Frazier et al. | 248/228 X |
| 4,138,079 | 2/1979 | Ehret et al. | 248/558 |
| 4,277,101 | 7/1981 | Vogel | 248/228 X |

FOREIGN PATENT DOCUMENTS

| | | | |
|---|---|---|---|
| 2100328 | 7/1971 | Fed. Rep. of Germany | 248/911 |
| 2031154 | 12/1971 | Fed. Rep. of Germany | 119/29 |
| 2048516 | 3/1971 | France | 119/29 |
| 2388578 | 11/1978 | France | 119/29 |
| 2455471 | 11/1980 | France | 119/29 |
| 2495489 | 6/1982 | France | 119/29 |

*Primary Examiner*—Carl D. Friedman
*Assistant Examiner*—Daniel Hulseberg
*Attorney, Agent, or Firm*—G. Donald Weber, Jr.

[57] ABSTRACT

A support device for supporting a rod or pole which is spaced above a surface, such as the ground. The support device includes an upright or vertical device, such as a post, with a shelf support selectively positioned thereto. The shelf support is adapted to support a barrier pole. The upright device is mounted to a support base by means of suitable mounting brackets.

14 Claims, 2 Drawing Sheets

265
211
300
302
304
305
202
210
303
203
301
3.
3.
403
401
410
402
100
400
204
200
2.
2.

SUPPORT DEVICES FOR PRODUCING VARIABLE HEIGHT BARRIERS

BACKGROUND

1. Field of the Invention.

This invention is directed, in general, to support devices for supporting a rod or pole at a variable height. In a particular application, the invention can be used as a cavaletti for equestrian sports or training.

2. Prior art.

One type of fence or barrier for equestrian sports or training comprises, generally, one or more horizontal poles, supported at each end thereof. In the past, the pole or poles were supported by, for example, rigid pillars or posts, by empty barrels, or the like. However, if a horse stumbled or fell and the horse or the rider hit such a pillar, post or barrel, serious injury could result. This type of accident is particularly likely to occur with young horses undergoing training.

This type of barrier was eventually replaced by training devices referred to as caveletti which, it is reported, were originally developed in Italy by Caprilli. Caveletti are frequently used in dressage and jumping training, as well as in competitions. A set of cavaletti can be stacked or arranged in many ways to form jumping obstacles of different heights.

Conventional cavaletti consist of two wooden cross-members as side supports with a rod or pole connected between the cross-members. Typically, the ends of the transverse member are each attached to one fork of one of the wooden cross-members. When the transverse member rests only in linear contact against the forks of the wooden cross-members, the connection of the transverse member and the wooden cross-members is not very stable. Of course, the transverse member can be attached to the cross-members in any suitable fashion.

With the transverse member being suitably attached to the cross-members, this kind of cavaletti can be placed in three positions by turning the cross-members. In the different positions, the transverse member is arranged to have a different height.

To achieve other height characteristics the caveletti can be stacked upon each other. However, when the cavaletti are stacked upon each other, only the ends (or feet) of the wooden cross-members rest one upon the other. Thus, the slightest bump or touch causes the cavaletti to be displaced and the stack collapses because of the relatively small contact surface of the ends of the cross-members of the cavaletti.

A disadvantage of these cavaletti is that they are not very high. Consequently, it is necessary to stack a number of these cavaletti to achieve an acceptable barrier height. If a jumping obstacle consists of this type of cavaletti, the danger of collapsing when bumped is great. This can cause injury to the horse and/or rider. Also, it is a disadvantage in that the jumping course is blocked for some time while the stack is rebuilt.

Another disadvantage of this cross-cross device is that lines and tethers associated with a horse can easily become entangled with the side supports. This condition can be dangerous to the horse and, as well as to the rider or trainer.

Another kind of cavaletti-type construction is known in which the side supports consist of horizontal planks. On the upper side of these planks is at least one semi-circular recess into which the ends of the transverse member are placed. Pedestals can be affixed to the bottoms of the planks in order to adjust the height of the transverse member. The height of the pedestals corresponds at least to the radius of the transverse member so that the cavaletti can be stacked.

This type of cavaletti has the disadvantage that it can be placed in only two positions of different heights, viz. with the transverse member on the top of the plank or with the transverse member on the ground.

Another type of cavaletti is described in United Kingdom Pat. No. 1,561,869 in the form of a horizontal pole, each end of which is permanently secured, by screwing, mortising or the like, to a rectangular support plate disposed perpendicularly to the length of the pole. Each rectangular support plate has a semi-circular recess in the middle of each of its circumferential sides. The end of the pole is securely fastened in one of these recesses, with one half of the cross section of the pole received in the recess and the other half protruding. To vary the height of the pole, the cavaletti is rotated about the axial length of the pole. Thus, the sides of the two plates to which the pole is attached may face upwards, downwards, or to either side so that the pole is at a high, low or intermediate height. One or more such cavaletti may be used to build a horse jump.

Another type of caveletti is shown and described in U.S. Pat. No. 4,414,920. In this device a three-dimensional rectangular block includes grooves for loosely receiving the transverse members or poles.

Reference is also made to a number of books or similar publications which are directed to horse training or the like. These publications refer to various aspects of cavaletti construction and usage.

One publication is "Basic Training of the Young Horse", by Reiner Kimke; J. A. Allen and Company, Ltd., 1985. Chapter 13 of this book is entitled "Caveletti Work".

Another publication is "Practical Eventing", by Sally O'Connor, U.S. Combined Training Association, Inc. Chapter 3 of this publication is entitled "Beginning Jumping Work" and shows a caveletti construction.

Another publications is "Training Showjumpers" by Anthony Paalman, J. A. Allen Company, Ltd. 1984.

PRIOR ART STATEMENT

In a search of the prior art, the following patents and publications have been discovered. These patents are listed in numerical order for convenience.

U.S. Pat. No. 4,414,920; BLOCK FOR SUPPORTING THE POLES OF EQUESTRIAN FENCES; Richards et al. This patent is directed to a block for use in supporting one end of an equestrian fence pole. Each face of the block has a groove for receiving one end of the pole. The three dimensions of the block are all different so that a pole can be supported at three different heights.

U.S. Pat. No. 4,239,168; RETAINING DEVICE FOR AN OBSTACLE RAIL; Colonna. This patent is directed to a retaining device for each end of a fence rail of the type used in horse jumping contests. It comprises a mounting piece and a bracket having two pins which can be inserted in an adjustable position in the holes of each side post. The mounting piece carries a U-shaped rail support which is capable of pivotal displacement about the pin of either a single or double hinge. The rail can be accurately positioned but falls freely when stuck.

U.S. Pat. NO. 4,199,138; GYMNASTICS AND GAME APPARATUS; Kaiser. This patent is directed to a gymnastics and game apparatus formed of a plurality of large-scale structural members made of plastic material in a box-shaped, elongated configuration and having patterns of recesses in the form of mortise openings and grooves in at least two opposite longitudinal lateral walls.

French Pat. No. 2,161,720; OBSTACLE; Wiegner. This patent is directed to an obstacle formed of plastic and used to provide a barrier.

British Pat. No. 1,561,869; CAVALETTI FOR HORSE SHOW-JUMPING; Gerhard et al. This patent is directed to cavaletti for horse and includes a block having grooves in four surfaces thereof for receiving poles or rods. The blocks can be stacked to provide different heights for the poles or rods which are supported thereby.

The publications referred to in the BACKGROUND section are included herein by reference.

SUMMARY OF THE INSTANT INVENTION

This invention is directed to a support structure which can be used as, inter alia, a cavaletti-type support or an accessory therewith. The support structure is made of any suitable material such as a type of high impact plastic or the like. The support base is rectilinear and has a generally square outer periphery. The thickness of the device is sufficient to permit the square block arrangement to stand in an upright position on any one of the sides thereof.

The improvement covered by the instant invention comprises an elongated support post which is mounted to the support base. The support post includes a plurality of apertures therethrough. The support post is, generally, adapted to be mounted in the vertical position. A support bracket includes at least one protrusion or pin which is insertable into the apertures in the support post. The bracket is adapted to support a transverse rod or pole. By moving the bracket from one aperture to another, the height of the pole or rod from the ground or other surface can be varied. Details of the respective components are described.

DESCRIPTION OF THE PREFERRED EMBODIMENT

Figures 1, 2, 3:
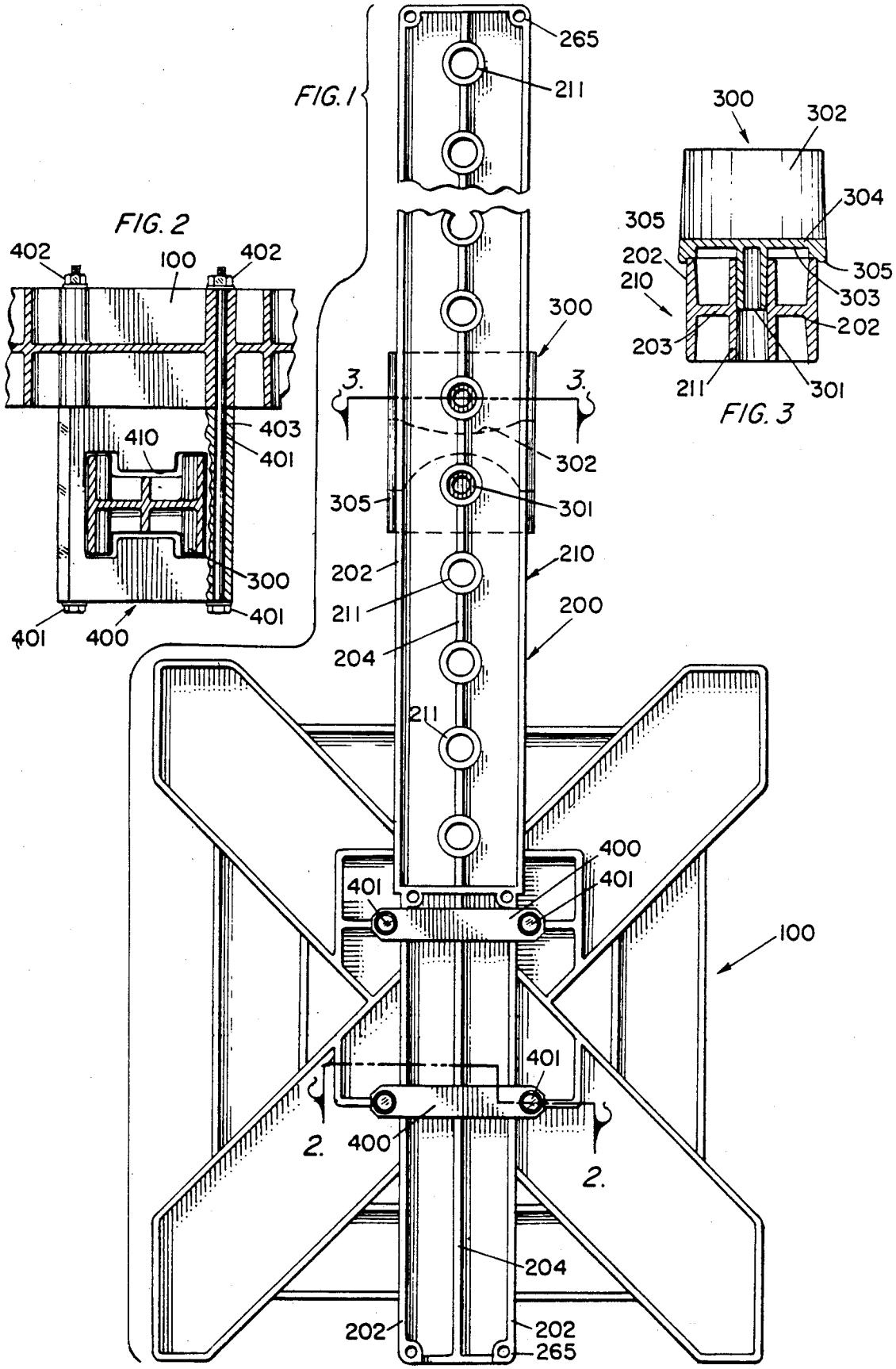
FIG. 1 is a plan view of the apparatus of the instant invention.
FIG. 2 is a partial top view, partial cross-sectional view taken along the lines 2—2 in FIG. 1.
FIG. 3 is a cross-sectional view of the upright support post and the support bracket taken along the lines 3—3 in FIG. 1.

Referring now to FIG. 1, there shown a plan view on an assembled cavaletti 100 and vertical support post 200 for selectively providing variable height barriers in accordance with the instant invention. As indicated above, the support device of this invention is directed primarily to a caveletti construction. However, it must be understood, that the structure has other uses, as well.

In particular, the invention includes two components which are arranged to interact. The first component is the X-shaped support base 100 which is essentially shown and described in the co-pending application Ser. No. 07/061,658 directed to a SUPPORT DEVICE FOR PRODUCING VARIABLE HEIGHT BARRIERS, by W. P. W. WONG, filed on June 15, 1987, now U.S. Pat. No. 4,827,873. For purposes of this discussion, it is merely necessary to describe the X-shaped support base 100 as having a pair of offset, non-symmetric arms with a receptacle formed therein and adapted to receive a transverse cross-bar. As described in the co-pending application, the support base 100 is adapted to be turned and placed on any of its sides. Because of the lack of symmetry of the base, the receptacle (and, thus, the transverse member supported thereby) is located at a different height from the surface for each position of the support base.

In this embodiment, the additional support post 200 is adapted to be supported by the X-shaped support base 100. More particularly, the post 200 is supported in a vertical position and extends a significant dimension above the support base 100. Thus, a much higher level of barrier can be produced by the combination of the support base 100 and the vertical support post 200.

As shown in FIG. 1, support post 200 is mounted to the support base 100 by means of a pair of mounting brackets 400. The mounting brackets 400 are each fastened to the support base 100 by means of appropriate bolts 401 which can pass through the respective mounting bracket 400 and, as well, through the support base 100. Of course, in an alternative embodiment, the base 100 can include threaded holes therein to which the bolts 401 can be engaged.

The mounting brackets 400, as shown in FIG. 1, are utilized in pairs in order to give additional rigidity and stability to the overall structure. Of course, any number of such mounting brackets 400 can be used. However, a single bracket would have less stability and three or more brackets would add additional cost, as well weight and so forth, to the structure.

The lower portion 2091 of the upright post 200 is, in essence, similar to an I-beam in configuration comprising a pair of relatively wide side plates 202 joined together by a central web-member 203 which is arranged perpendicular to and joined along the center lines of the side plates 202. An additional inner plate 204 is provided, primarily to provide additional strength for the support post 200. The inner plate 204 is substantially intermediate the side plates 202 and parallel thereto. The inner plate 204 is also perpendicular to the web-member 203.

The upper portion 210 of the vertical support post 200 is of a substantially similar I-beam configuration. However, the upper portion 210 also includes a plurality of tubes or hollow cylinders 211 in line with the inner plate 204. These tubes or hollow cylinders 211 provide ports through the post 200. In addition, the cylinders 211 (or through-ports) have the same height as the side plates 202 on the upright post.

The cylinders 211 are arranged in linear alignment, substantially in the center of the post 200 primarily for strength. The vertical alignment of the cylinders has a periodic basis so that uniform increments or steps can be obtained when the support post 200 is used in a jumping or barrier mode. Of course, any other suitable arrangement of the through-port cylinders 211 can be provided.

A support bracket 300 is adapted to the mounted on the support post 200 by inserting suitable projections 301 (see FIG. 3) on one side thereof into the through-ports 211 in the support post. In the preferred embodiment, each support bracket 300 includes two projections or pins which are inserted into the through-ports 211 in the post. The plugs 301 may be hollow cylinders as shown, and may be tapered, if desired. Two plugs or pins provide stability and strength. Of course, any number of plugs can be used.

In addition, the support bracket 300 includes a shelf or support lip 307 (shown in dashed lines in FIG. 1) onto which a barrier can be placed. The lip is, of course, on the side of the support bracket 300 which is opposite from the plug 301. The shelf or lip 302 includes upper and lower surfaces. The upper and lower surfaces have different arcs of curvature for receiving different size posts or barriers and/or for providing different degrees of stability in maintaining the pole or barrier on the shelf 302. Thus, the shelf surface 302A with the deeper arc of curvature will retain the bar more rigidly than will the shelf surface 302B with the shallower arc of curvature. Thus, the barrier can be dislodged from the surface 302B of the shelf which is the shallow arc of curvature much more readily than it can be dislodged from the surface 302A of the shelf having the deeper arc of curvature.

In FIG. 1 a plurality of mounting holes 265 are shown at the edges of post 200. These holes pass through the post. In another application of the apparatus, the base support 100 can be omitted and the post 200 can be mounted to a wall fence or other support device by means of screws, bolts or the like passed through the mounting holes 265.

Reference is now made to FIG. 2 which is a view taken along the lines 2—2 in FIG. 1. In FIG. 2, a partial cross-section of the support base 100 is provided along with a partial cross-section of the upright post 200 as well as a partial cross-section of the bracket 400. It is seen that the bolts 401 pass through apertures in the outer edges of the bracket. The bolts 401 also pass through appropriate through-holes 403 in the support base 100. The bolts are then engaged by an appropriate combination of washers and nuts 402 on the inner surface of the support base 100. The method of providing the through-holes 403 in the support base 100 is conventional and is suggested in the aforementioned co-pending application of Wong. Of course, the bosses or the through-holes 403 in the support base 100 can be located and established in accordance with the instant design and are not limited to the design shown in the co-pending application.

It is seen that a bracket 400 includes a relatively thick planar section which may be rounded or otherwise formed on the side edges, if so desired. An aperture 410 is formed through the bracket 400. The aperture 410 has an I-shape which is adapted to receive the bottom portion 201 of support post 200. Preferably, the fit between the post 200 and the aperture 410 is fairly snug so as to provide stability to the support post 200. Thus, it is seen that the bracket 400 is attached to the support base 100 by means of the nuts and bolts as shown. The bottom portion of the support post 211 is then inserted into and passes through the I-shaped opening 410 in the bracket 400.

Where more than one bracket 400 is used, as for example shown in FIG. 1, the bottom portion 201 of the post is passed through all of the brackets. While not illustrated in the Figures, a suitable locking arrangement can be incorporated, as for example, by means of a set screw or the like which can be applied through the end of the bracket.

Referring now to FIG. 3, there shown a cross-sectional view of the upper portion 210 of the post 200 taken along the lines 3—3 of FIG. 1. In FIG. 3, the vertical side walls 202 of the upper portion 210 of the post 200, as well as the web 203, are shown. The web 203 is shown joined to the mid-portion of the hollow cylinder or tube which forms the through-port 211. As shown in FIG. 3, the hollow cylinder 211 includes a slightly tapered configuration from the outer ends to the mid-portion thereof. The taper is such that the inner or mid-portion of the cylinder 211 is slightly smaller than the outer portion. This arrangement permits the plugs or pins 301 of the shelf or support member 302 to engage the cylinders 211 securely. While not required, the plugs 301 may also have a tapered configuration in order to enhance this arrangement.

In addition, there is shown a partial cross-sectional view of the shelf or support bracket 300. That is, the bracket 300 includes the plug portion 301 which is adapted to be inserted into the tubular through-port 211 of the vertical post 200. As shown, the plug or pin 301 can be fabricated to be hollow wherein the plug has a certain amount of flexibility and can be inserted into the tube 211 with a "force fit" arrangement.

The back portion 304 of the support bracket 300 includes recesses 303 in the embodiment shown. These recesses need not be provided other than to establish a certain thickness of the back 304 while reducing the amount of material actually utilized because of the use of the recesses.

As shown in FIG. 3, the back portion 304 of the support bracket 300 includes the lips 305 which overlap and encompass the outer surfaces of the side walls 202 of the upper portion 210 of the post 200. Such overlapping lips provide additional stability to the support bracket 300. Of course, the lips 305 may be omitted, if desired.

Figure 4:
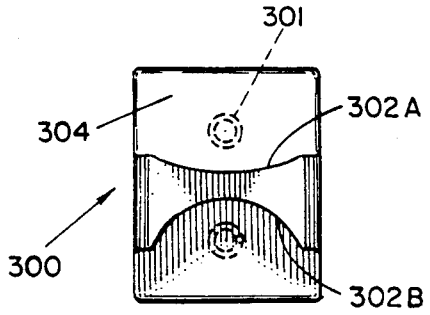
FIG. 4 is a plan view of the support bracket.

Referring now to FIG. 4, there shown is a plan view of the support bracket 300. The support bracket includes the back portion 304 and the support shelf 302 or ledge which includes the two surfaces 302A and 302B with different curved surfaces. The plugs or pins 301 for mounting in the through ports within the vertical post are shown in the dashed outline.

As noted above, the support brackets 300 have a relatively shallow curved surface 302B and a relatively deep curved surface 302A. In a typical arrangement, the upper most support bracket 300 can be arranged with the shallow curved surface 302B upwardly to support a cross-member in a relatively loosely mounted fashion. Thus, the upper most barrier bar can be reasonably easily dislodged during a jumping exercise thereby to avoid injury to the horse or rider. Conversely, support shelf 300 can be mounted with the deep curved section 302A upwardly so as to more securely retain the cross-member therein.

Figure 5:
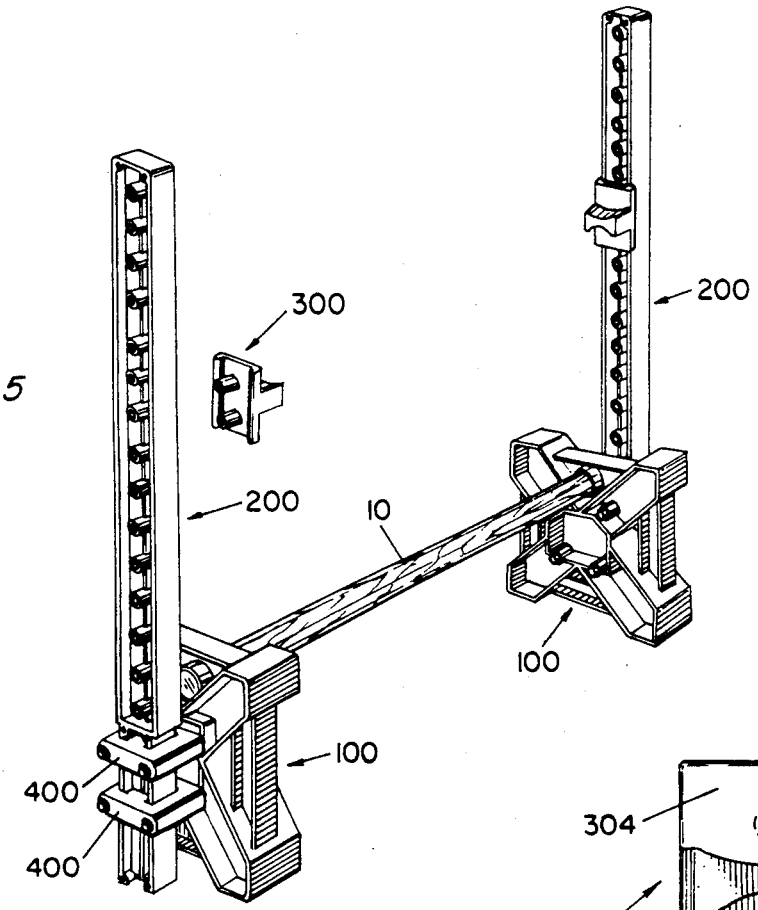
FIG. 5 is an isometric view of the assembled cavaletti of the instant invention showing a pair of upright support posts and a representative cross-bar attached thereto.

Referring now to FIG. 5, there shown a perspective view of a one application of the apparatus of the instant invention. In this case, a pair of support bases 100 are arranged in spaced apart relationship. A separate vertical support post 200 is mounted to each of the support bases by means of the mounting brackets 400 shown and described supra. A pair of support brackets 300 are shown in conjunction with the vertical posts. One support bracket 300 is mounted in the support post while another support bracket 300 is shown adjacent to a support post 200, in an exploded view arrangement. It is seen that the support brackets 300 are adapted to be plugged into the cylinders 211 in the upper portion 210 of the support posts.

In addition, a transverse member 10 (e.g. a rod or pole) is disposed between the support bases 100. A similar transverse member can be inserted onto the support brackets 300 when they are both assembled to the respective upright support posts. The lower transverse member 10 will then provide rigidity to the system. WHen used alone, the transverse member 10 can also operate as a relatively low caveletti. When additional transverse members are placed on the support brackets 300, an elevated barrier is provided. As noted, the lower transverse member 10 provides additional rigidity and stability to this system. Of course, additional support brackets 300 and transverse members 10 can be used to add additional rigidity and stability to the barrier.

Figure 6:
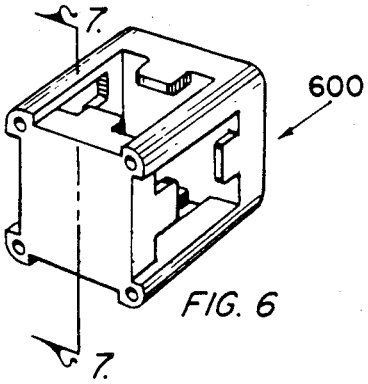
FIG. 6 is an isometric view of an alternative mounting braket for the upright member.
Figure 7:
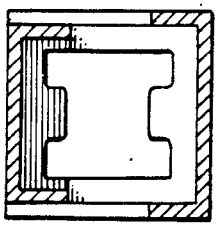
FIG. 7 is a cross-sectional view of the alternative mounting bracket taken along the lines 7—7 in FIG. 6.
Figure 8:
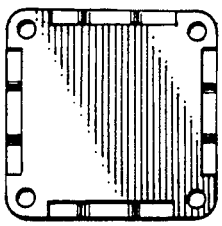
FIG. 8 is an end or plane view of the alternative mounting braket shown in FIGS. 6 and 7.

Referring now to FIGS. 6, 7 and 8, there is shown an alternative mounting bracket for use with the system. In essence, the mounting bracket 600 is equivalent to a cubic arrangement of the mounting brackets 400 shown in FIGS. 1, 2 and 5. As I-shaped opening 601 or 602 can be formed in opposing sides of brackets 600 in order to receive the I-beam shaped post 200. Alternatively, intersecting I-shaped slots can pass through the bracket 600. With the alternative arrangement, a single mounting bracket is fixed to the support base 100 by means of the nuts and bolts 401 and 402 which pass through openings 610 in the bracket, shown in FIGS. 1, 2 and 5. The solid faces 612 614 add strength and rigidity to the bracket. However, with the through slots 601 or 602 therein, the bracket 600 can be substantially permanently mounted on the support base 100 and need not be removed and relocated when the support base 100 is rotated.

In particular, FIG. 6 is an isometric view of the alternative mounting bracket while FIG. 7 is a cross-sectional view thereof taken along the lines 7—7 in FIG. 6. FIG. 8 is an end view of the alternative mounting bracket as viewed from the mounting end thereof.

Thus, there is shown and described a preferred embodiment of the instant invention. The invention includes a base support, a vertical upright support post and at least one support bracket or shelf adapted to be inserted therein and a suitable mounting bracket for mounting the vertical upright support post to the support base. When assembled, these items can be used to provide a support for a cavaletti or similar type of barrier. Typically, the devices are used in pairs to provide supports for opposite ends of a barrier rail or post.

The preferred embodiment has been described. Those skilled in the art may conceive of modifications or variations to the described embodiment. However, any such modifications or variations which fall within the purview of this description are intended to be included therein, as well. The description is intended to be illustrative only and is not intended to be limitative. Rather, the scope of the invention is limited only by the claims appended hereto.

What is claimed:

1. A support apparatus comprising, a support base defining a relatively planar vertical surface, mounting means detachably connectable to said support base adjacent to the center of the support base and substantially perpendicular to said vertical planar surface thereof, said mounting means having at least one aperture therethrough, an elongated support member configured to interlock in said aperture of said mounting means substantially parallel to the planar surface of said support base and extend thereabove, said elongated support member including a plurality of parallel, spaced apart tubular through-ports mounted thereon, and support bracket means having at least one pin and one shelf extending in opposite directions therefrom, said pin adapted to be snugly engaged within any of said tubes, thereby to support said support bracket means on said elongated support member above said support base.

2. The apparatus recited in claim 1 wherein, said mounting means comprises a substantially cubic device with apertures passing therethrough in two perpendicular directions to selectively snugly receive said elongated support member in either of said directions.

3. The apparatus recited in claim 1 wherein, said shelf has at least two surfaces, each of said surfaces has a different radius of curvature.

4. The apparatus recited in claim 1 wherein, said at least one pin has a tapered configuration.

5. The apparatus recited in claim 1 wherein, said support bracket means includes lips at the sides thereof to engage said elongated support member.

6. The apparatus recited in claim 1 wherein, said elongated support member has a generally I-shaped configuration including a pair of parallel, spaced apart side flanges joined by an intermediate web member.

7. The apparatus recited in claim 1 wherein, said at least one aperture has a generally I-shaped configuration.

8. The apparatus recited in claim 2 wherein, said apertures intersect within said substantially cubic device.

9. The apparatus recited in claim 1 wherein, said support base comprises an X-shaped component.

10. The apparatus recited in claim 1 wherein, each of said tubular has a tapered configuration.

11. The apparatus recited in claim 1 wherein, said at least one pin comprises a hollow tube.

12. The apparatus recited in claim 1 wherein, said plurality of tubular comprise hollow, tubular ports mounted to said intermediate web and spaced from each of said flanges.

13. The apparatus recited in claim 12 wherein, said tubular are spaced apart by uniform increments.

14. The apparatus recited in claim 13 wherein, said support bracket means includes at least two pins therefrom which mate with two of said ports.

* * * * *